United States Patent [19]

Luker

[11] Patent Number: 4,585,151

[45] Date of Patent: Apr. 29, 1986

[54] CHILD RESISTANT DISPENSER

[75] Inventor: Edward Luker, Evansville, Ind.

[73] Assignee: Sunbeam Plastics Corporation, Evansville, Ind.

[21] Appl. No.: 668,506

[22] Filed: Nov. 5, 1984

[51] Int. Cl.[4] ..... B67D 5/32

[52] U.S. Cl. ..... 222/153; 222/555; 222/559; 222/561

[58] Field of Search ..... 222/153, 476, 548, 556, 222/555, 557, 562, 560, 561, 559, 554, 545, 544; 215/313

[56] References Cited

U.S. PATENT DOCUMENTS

| | | | |
|---|---|---|---|
| 2,970,724 | 2/1961 | Lacy | 222/545 X |
| 3,104,039 | 9/1963 | Dike | 222/548 X |
| 3,214,069 | 10/1965 | Dike | 222/545 X |
| 4,299,339 | 11/1981 | Giroux et al. | 222/548 X |

*Primary Examiner*—Joseph J. Rolla
*Assistant Examiner*—David H. Bollinger
*Attorney, Agent, or Firm*—Fisher, Crampton, Groh and McGuire

[57] ABSTRACT

A two piece safety or child resistant closure for a container in which one piece is a cylindrical cap which is attached to the container by threads or by a flange to snap onto the container. The cap has a dispensing orifice which may be located on the end of a spout through which the contents of the container are dispensed. The second piece of the closure is a cover which is rotatably connected to the cap. When the cover is rotated to its closed position, the dispensing orifice is covered and sealed and the cover is locked against rotation. A rocker arm occupying a portion of the cover is connected to the cover by a torsion hinge and contains the locking mechanism. In order to put the closure into its dispensing position, the rocker arm must be depressed at the same time that the cover is rotated. Rotation of the cover to the dispensing position uncovers the dispensing orifice. When the cover is rotated back to its closed or sealed position, the rocker arm drops back into its original position engaging the lock.

18 Claims, 14 Drawing Figures

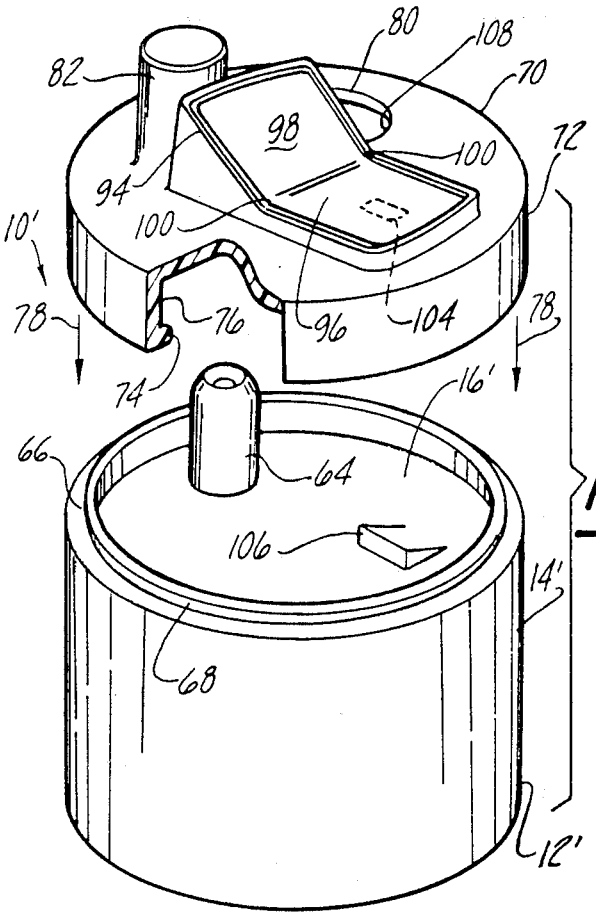
Fig-6
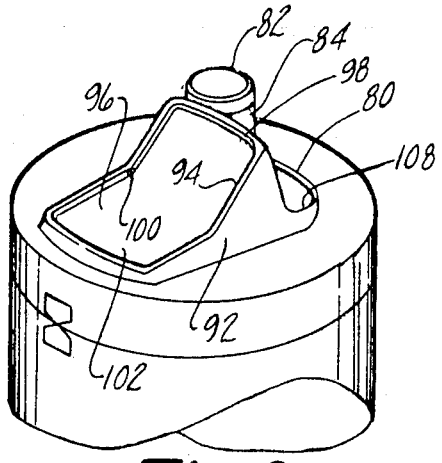
Fig-9
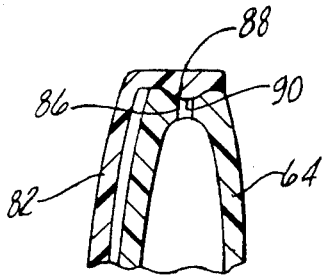
Fig-10
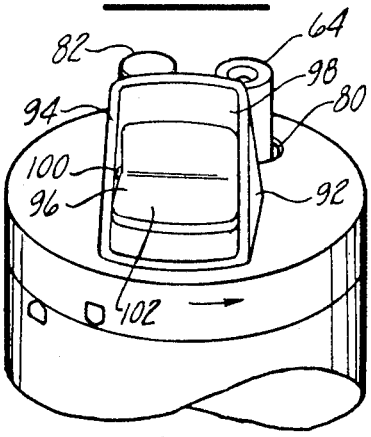
Fig-11
Fig-12
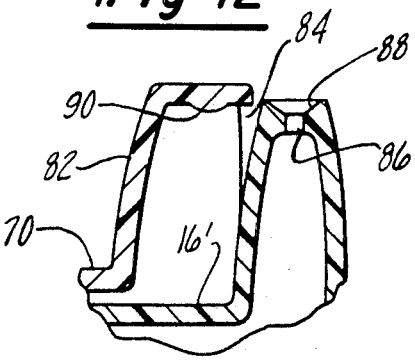
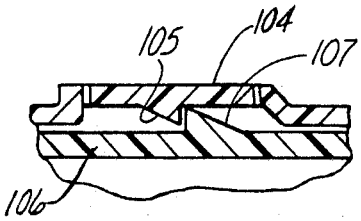
Fig-13
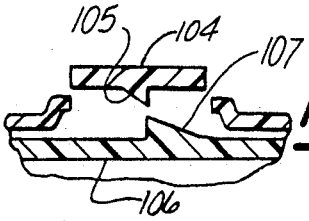
Fig-14

CHILD RESISTANT DISPENSER

This invention relates to a safety or child resistant closure and more particularly to a two piece safety dispensing closure.

There are a wide variety of so-called child resistant or safety closures which require simultaneous or sequential motions to move from a closed to an open position, the combination of motions making it relatively difficult for children to open. Many attempts have produced closures which are difficult for adults to open due to the force required. It is therefore a general object of this invention to provide a safety closure which requires simultaneous or concurrent motions but not excessive force to open the closure.

Another object of this invention is to provide a safety closure in which the dispensing orifice is sealed when the container is in a closed, locked condition.

Still another object of this invention is to provide a safety closure in which a cover is rotatably secured to a cap, and the degree of rotation is limited in both the opening and closing direction.

The objects of the invention are accomplished by a two piece safety dispensing closure in which the first piece is a cylindrical cap having threads or a flange arrangement for snap-on attachment to a container. The cap has an orifice through which the contents of the container are dispensed. A cover is fixed to the cap for rotation between an open condition in which the orifice is exposed for dispensing and a closed condition in which the orifice is sealed and the cover is locked so that it cannot be opened by rotation in either direction. Sealing is obtained by providing a ball seat surrounding the orifice on the cap which coacts with a ball surface on a rotatable cover. To further assure a good seal, an interference fit is used between the ball and seat members. The cover contains a rocker arm which is preferably integrally connected to the rest of the cover by a molded torsion hinge which keeps the rocker arm in its closed condition. Locking lugs are connected to the rocker arm and to the cap, and these lugs are engaged when the closure is closed and the dispensing orifice sealed. In order to rotate the cap in an opening direction, the rocker arm must be depressed, disengaging the locking lugs, during the initial opening rotation of the cover. Rotation of the cover is limited in an opening direction. When the cover is rotated in a closing direction, the rocker arm drops back to its normal position locking the cover against rotation in either direction while the dispensing orifice is sealed. The cover may be provided with a dispensing spout and in one embodiment the cover has a spout cover providing the seal in the locked, closed condition.

The preferred embodiments of the invention are illustrated in the drawing in which:

FIG. 6 is an exploded perspective view similar to FIG. 1 of another embodiment of the invention;

FIG. 9 is a perspective view of the embodiment of the invention shown in FIG. 6 with the cover rotated to its closed position with the spout cover in place and the rocker arm in its locked position;

FIG. 10 is a fragmentary cross-sectional view of the dispensing nozzle and cover shown in its closed and sealed position of FIG. 9;

FIG. 11 is a perspective view of the closure similar to FIG. 9 showing it in its open, dispensing position with the rocker arm pivoted to its nonlocked position;

FIG. 12 is a fragmentary cross-sectional view similar to FIG. 10 but showing the dispensing nozzle and its cover in the open, dispensing position of FIG. 11;

FIG. 13 is a fragmentary cross-sectional view of the cooperating part of the locking mechanism shown in its locked position;

FIG. 14 is a fragmentary cross-sectional view similar to FIG. 13 showing the locking mechanism in its open position as it would be in FIG. 11.

Figure 1:
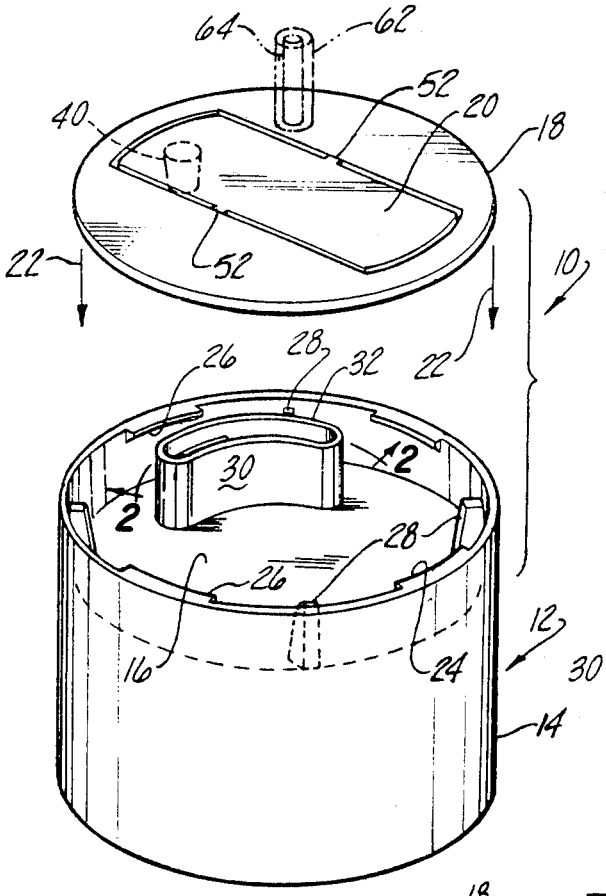
FIG. 1 is an exploded perspective view of the closure embodying the invention.
Figure 2:
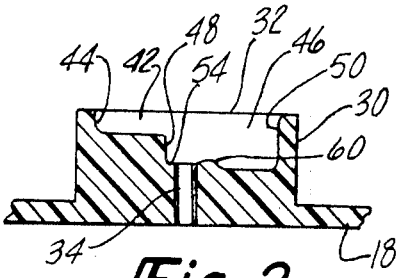
FIG. 2 is a cross-sectional view of a portion of the closure taken along line 2—2 of FIG. 1 showing some of the details of the sealing and locking projection.
Figure 3:
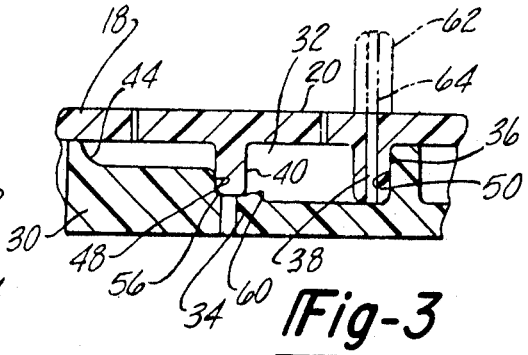
FIG. 3 is an enlarged cross-sectional view similar to FIG. 2 but showing the cover and rocker arm as they interact with the cap when the closure is in the closed position.
Figure 4:
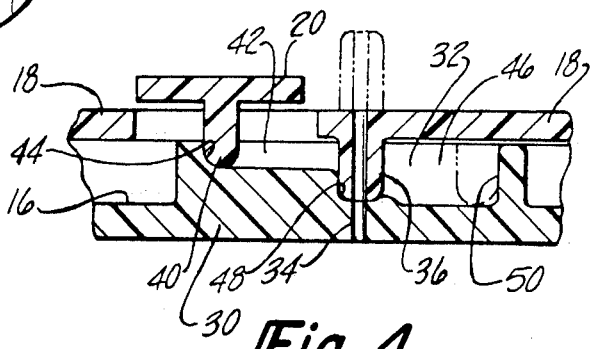
FIG. 4 is a cross-sectional view similar to FIG. 3 showing a portion of the closure in the open-dispensing position after the rocker arm has been actuated and the cover rotated.
Figure 5:
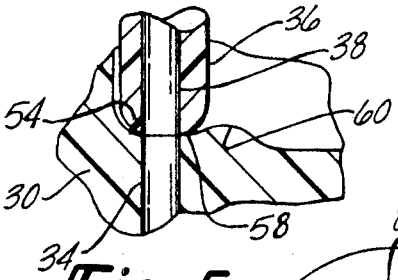
FIG. 5 is a fragmentary cross-sectional view showing on an enlarged scale the sealing of parts shown in FIG. 4.
Figure 7:
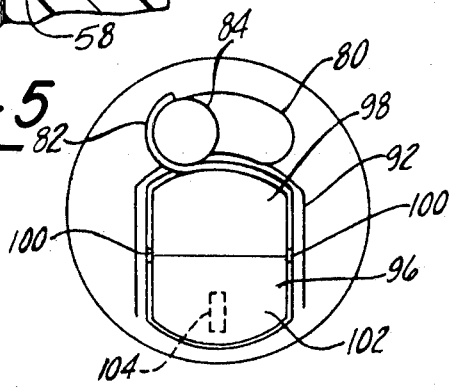
FIG. 7 is a top view of the closure showing the cover with its rocker arm, the spout cover and the circumferential slot in which the dispensing spout moves from a closed to an open dispensing position.
Figure 8:
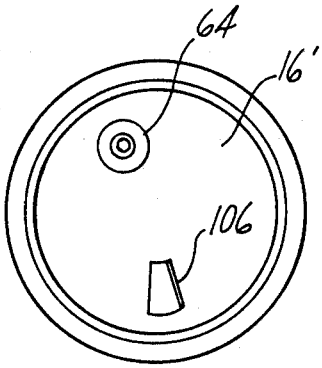
FIG. 8 is a plan top view of the closure cap with cover removed showing the dispensing spout and the location of the locking lug.

Referring to FIGS. 1 through 5, a safety or child-resistant closure package embodying the invention is designated generally at 10. Closure 10 is a two piece dispensing type closure which is adapted to be applied to a standard container with a conventional fastening means, the closure 10 including a cap 12 having a cylindrical body portion 14 the interior of which contains screw threads or other conventional fastening means such as snap-on flanges and a recessed top 16. A disc-shaped cover 18 having a rocker arm 20 is adapted to snap onto cap 14 as shown by downwardly directed arrows 22 in FIG. 1. Cap 12 has an inwardly extending lip 24 at the top of cylindrical wall 14 which conveniently may take the form of four equally spaced flanges 26 which may typically subtend an arc of 20 to 45 degrees. Extending upwardly from recessed top 16 are pedestals 28 which are located in the center of the spaces between flanges attached to the inside of cylindrical wall 14 and terminating with a flat surface below the bottom of flanges 26 by a distance approximating the thickness of cover 18. Cover 18 thus can be snapped onto cap 12 in a direction of downwardly pointed arrows 22 to be supported on pedestals 28 and retained by flanges 26 for rotation relative to cap 12. Cap 12 is formed with an upwardly extending projection 30 having a two level recess 32 as shown in FIG. 2 which contains dispensing orifice 34 which is in open communication with the container (not shown) to which closure 10 is applied. As shown in FIG. 1, projection 30 has generally circumferentially extending inner and outer walls as does recess 32. Projection 30 is adjacent the inside of cylindrical wall 14 being spaced apart sufficiently to accommodate pedestal 28. Cover 18 has depending protuberance 36 (see FIGS. 3–5) containing a dispensing opening 38. Cover 18 also has a depending plug 40 extending from the rocker arm portion 20. Protuberance 36 and plug 40 are circumferentially aligned with recess 32 and dispensing orifice 34 so that the cover may be rotated to a first closed position where plug 40 seals dispensing orifice 34 and to a second dispensing position where protruberance 36 overlies dispensing orifice 34 (see FIG. 5) putting dispensing opening 38 in sealed fluid communication with dispensing orifice 34. As can be seen in FIG. 2, the two level recess 32 in projection 30 consists of a shallower cavity 42 having an end wall 44 at one end and the other end extending into deeper cavity 46 with end wall 48 adjacent the shallower cavity and end wall 50 at its other end. Dispensing orifice 34 extends through cover 18 into deeper cavity 46 adjacent end wall 48. With cover 18 snapped into place on cap 12 and cover 18 rotated to its first closed position, plug 40 and protuberance 36 will extend into deeper cavity 46 with plug 40 sealing dispensing orifice 34 and preventing rotation in a counterclockwise direction as it abuts against end wall 48, see FIG. 3. Protuberance 36 abuts against end wall 50, preventing rotation in a clockwise direction. Rocker arm 20 is pivotably connected to cover 18 at molded torsion hinges 52 so that as end 54 of rocker arm 20 is depressed, plug 40 will be lifted from its sealing position with orifice 34 permitting counterclockwise rotation of cover 18 allowing the plug 40 to move in shallower cavity 42 until it abuts against end wall 44, preventing any further rotation of the cover in this counterclockwise opening direction. Protuberance 36 has remained in deeper cavity 46 and now is in a position adjacent end wall 48 with dispensing opening 38 being aligned in sealing relationship to dispensing orifice 34. While I prefer to limit the counterclockwise rotation of the cover in the opening direction by the abutment of plug 40 with end wall 44, this limit could have been established by the abutment of protuberance 36 against end wall 48. Closure 10 may be returned to its first closed position by rotation of cover 18 in a clockwise direction until plug 40 drops into deeper recess 46 as the rocker arm 20 returns to its initial flat planar position with plug 40 and protuberance 36 locking cover 18 against rotation in either direction and plug 40 sealing the dispensing orifice 34. In order to assure proper sealing of dispensing orifice 34 with plug 40 in its closed position and with protuberance 36 in its open dispensing position, a ball seat recess 54 is formed around orifice 34 in deeper cavity 46 to cooperate with ball seal 56 on the end of plug 40 and ball seal 58 formed on the end of protuberance 36. To further assure good sealing, a slight step 60 is formed adjacent ball seat recess 54 to create an interference fit between ball seal 56 on plug 40 when the cover 18 is in its first closed position and with ball seal 58 on protuberance 36 when the cover is in its second open dispensing position—see FIG. 5. Optionally, cover 18 may be provided with a nozzle or spout 62 having an opening 64 in line with dispensing opening 38 in protuberance 36.

Referring to FIGS. 6 through 14, another embodiment of the two piece safety or child-resistant dispensing closure 10′ is shown having a generally cup-shaped cap 12′ with cylindrical wall 14′ provided internally with means such as threads or flanges to screw on or snap onto a container (not shown). Cap 12′ has a recessed top 16′ with a dispensing spout 64 extending vertically upward therefrom. Circumfential groove 66 is cut or formed in the side of cylindrical wall 14′ near its top to form outwardly extending circumferential flange 68. Cover 70 is formed with a depending or downwardly extending skirt 72 having an inwardly directed circumferential flange 74 at its end defining a channel 76 to accept cap flange 68 when the cover is snapped onto the cap in the direction shown by arrows 78 in FIG. 6. Cover 70 has a circumferential slot 80 formed in its top to accept spout 64 therethrough. Upwardly extending spout cover 82 is connected to cap 70 so that it overlies one end of slot 80. Cover 82 has a vertically extending opening 84 in line with circumferential slot 80 to receive spout 64 as the cover is rotated to its first closed position wherein the spout cover 82 overlies spout 64. Referring to FIGS. 10 and 12, spout 64 contains a dispensing orifice 86 along with a surrounding ball seat recess 88 which cooperates with ball seal 90 formed on the inside top of spout cover 82 to fully seal orifice 86 when the cover is in its closed position. Additionally, an interference fit is supplied between the ball 90 and seat 88 to assure a complete seal. A vertically extending rocker arm guard 92 is formed on the top of cover 70 with an upwardly slanted surface 94 to receive rocker arm 96 having an upwardly angled surface 98 corresponding to the slant 94 of rocker arm guard 92. Rocker arm 96 is pivotably connected to guard 92 by molded torsion hinges 100. Attached to the underside of the flat portion 102 of rocker arm 96 is a locking lug 104 (see FIG. 7) which cooperates with locking lug 106 formed on recessed top 16′ of cap 12′ to lock cover 70 against rotation when cover 70 is in its first closed position with spout cover 82 overlying spout 64 sealing the dispensing orifice. In order to rotate cover 70 to expose the spout 64 for dispensing, rocker arm 96 is depressed on its inclined surface 98 to disengage locking lugs 104 and 106. Cover 70 can then be rotated in a counterclockwise direction allowing spout 64 to move in circumferential slot 80 to its second dispensing position. Rotation of the cover is limited in its counterclockwise opening direction by engagement of spout 64 with slot end wall 108. When it is desired to close the container, cover 70 is rotated in a clockwise direction until the rocker arm drops or snaps back to its original position by the action of torsion hinges 100, and rocker arm locking lug 104 engages cap locking lug 106 to lock the cover against rotation in either direction. In the closed position, spout 64 could engage the end wall of circumferential slot 80 to alternatively limit clockwise rotation. Spout 64 could also engage the side wall of spout cover 82 to similarly limit closing rotation. The engagement of ball seal 90 with ball seat 88 completely seals dispensing orifice 86 in this second closed position. Lugs 104 and 106 have cooperating loading ramps 105 and 107 respectively on which they slide relative to one another during the closing clockwise rotation of cover 70.

The embodiments of the invention in which an exclusive property or privilege is claimed are defined as follows:

1. A two piece safety dispensing closure for a container comprising, in combination:

a cylindrical cap having means for attachment to a container and a dispensing orifice therethrough;

a cover affixed to said cap for rotation relative thereto;

means carried by said cover for sealing said orifice when said cover is in a first closed position;

means carried by said cover for stopping said cover in a second rotational position for dispensing from said container through said orifice; and a rocker arm occupying a portion of said cover and being pivotably connected thereto by a torsion hinge, said rocker arm having means for locking said cover against rotation in said first closed position and upon depression of said rocker arm for releasing said cover for rotation to said second dispensing position.

2. The safety dispensing closure of claim 1 wherein the means for sealing said orifice comprises a ball seat recess surrounding said orifice cooperating with a ball seal carried by said cover, whereby when said cover is rotated to said first closed position, said ball seal engages said ball seat recess to seal said dispensing orifice.

3. The safety dispensing closure of claim 2 wherein an interference fit exists between said ball seal and said ball seat recess to insure sealing of said dispensing orifice when said cover is in its first closed position.

4. The safety dispensing closure of claim 2 wherein said means for sealing said dispensing orifice includes a plug depending from the underside of said rocker arm, said plug having said ball seal surface at its free end for engaging said ball seat recess.

5. The safety dispensing closure of claim 2 wherein said dispensing orifice is located on said cap at the end of an upwardly extending spout and said means for sealing said dispensing orifice includes an upwardly extending spout cover, said spout cover carrying said ball seal surface on the underside thereof whereby when said cover is rotated to said first closed position, said spout cover overlies said spout and said ball seal engages said ball sealed recess to seal said dispensing orifice.

6. A two piece safety dispensing closure for a container comprising, in combination;

a cylindrical cap having means for attachment to a container and a circumferential groove adjacent to top thereof defining with said top a flange, said cap having an upwardly extending spout with a dispensing orifice extending therethrough;

a cover having a downwardly extending skirt with an inwardly directed circumferential flange at the open end thereof defining a channel to accept the said flange, on said cap when said cover is snapped onto said cap, said inwardly directed flange on said cover extending into the circumferential groove on said cap to retain said cover for rotation relative to said cap, said cover having a circumferential slot through which said spout extends and in which said spout slides as said cover is rotated relative to said cap, and an upwardly extending spout cover overlying one end of said slot and having a vertical opening in line with said slot to receive said spout as said cover is rotated relative to said cap; and a rocker arm occupying a portion of said cover and being pivotably connected thereto by a torsion hinge, said rocker arm having means for locking said cover against rotation in a first closed position wherein said spout cover overlies said spout and upon depression of said rocker arm, said locking means is released and said cover can be rotated in a direction to expose said spout in a second dispensing position.

7. The safety dispensing closure of claim 6 wherein said spout has a ball seat recess on the upper end thereof and said spout cover has a ball seal surface on the underside thereof whereby when said cover is rotated to said first closed position with said spout cover overlying said spout, said ball seal engages said ball seat recess to seal said dispensing orifice.

8. The safety dispensing closure of claim 7 wherein an interference fit exists between said ball seal and said ball seat recess to insure sealing of said dispensing orifice when said cover is in its first closed position.

9. The safety dispensing closure of claim 6 wherein rotation of said cover in one direction is limited at said first closed position by engagement of said spout with one end of said circumferential slot with said spout cover overlying said spout and said dispensing orifice being sealed, and said cover is limited in rotation in the other direction by engagement of said spout with the other end of said circumferential slot in said second dispensing position.

10. The safety dispensing closure of claim 6 wherein locking means on said rocker arm includes a locking lug which engages a cooperating locking lug on said cap when said cover is rotated to its first closed position, and upon depression of said rocker arm, said locking lugs are disengaged to permit rotation of said cover relative to said cap.

11. The safety dispensing closure of claim 10 wherein said locking lugs on said cap and rocker arm have cooperating ramps so that as said cover is rotated from a second opened dispensing position towards said first closed position, said ramps cooperate with each other pivoting said rocker arm until said first position is reached and said rocker arm returns to its original position with said lugs engaged in a locking position.

12. The safety dispensing closure of claim 11 wherein a rocker arm guard is formed integral with said cover having an upwardly slanted surface to receive a portion of said rocker arm which has an angled surface corresponding to said slant to provide an inclined surface for depression of said rocker arm.

13. The safety dispensing closure of claim 12 wherein said rocker arm locking lug is located on the underside of said rocker arm opposite to said inclined surface and is generally horizontal in its first closed position when said lugs are in locking engagement.

14. A two piece safety dispensing closure for a container, comprising, in combination:

a cylindrical cap having means for attachment to a container, a recessed top, and inwardly extending lip at the top end of the cylindrical wall overlying said recessed top, and pedestal support means extending upwardly from said recessed top terminating below said lip, and a projection extending upwardly from said recessed top and containing a dispensing orifice extending therethrough;

a disc shaped cover supported by said pedestal means and retained by said lip for rotation relative to said cap, said cover having a depending protuberance with a dispensing opening extending therethrough; and a rocker arm occupying a portion of said cover and being pivotably connected thereto by a torsion hinge, said rocker arm having a depending plug for sealing said dispensing orifice;

whereby said cover is locked against rotation by said plug and said protuberance in cooperation with said projection in a first sealed position, and upon depression of said rocker arm, releasing said cover for rotation in a direction to align said dispensing opening with said dispensing orifice in a second dispensing position.

15. The safety dispensing closure of claim 14 wherein said lip includes a plurality of equally spaced flanges and said pedestal support means includes a plurality of pedestals individually positioned in the spaces between the flanges.

16. The safety dispensing closure of claim 14 wherein said projection contains a two level circumferential recess in which the plug and protuberance are constrained to move upon rotation of said cover, said dispensing orifice being located in a deeper cavity portion of said recess adjacent an end wall of said projection merging into a shallower cavity portion of said recess, said cover being locked against rotation in said first sealed position by abutment of said plug with one end wall of said deeper cavity and abutment of said protuberance with the other end wall of said deeper cavity, said plug sealing said dispensing opening, and, upon depression of said rocker arm, said cover is released for rotation in an opening direction by said plug moving out of said deeper cavity to the depth of said shallower cavity for rotation in an opening direction to said second dispensing position, where said plug abuts against an end wall of said shallower cavity to prevent further rotation in an opening direction and said dispensing opening in said protuberance is in line with said dispensing orifice in said deeper cavity in said projection.

17. The safety dispensing closure of claim 16 wherein said dispensing orifice is surrounded by a ball seat recess and said plug and said protuberance have ball seal surfaces on the ends thereof, whereby, when said cover is in said first sealed position, the ball seal on said plug engages said ball seat to seal said dispensing orifice, and, when said cover is in its second dispensing position, the ball seal on said protuberance engages the ball seat to seal said dispensing opening in communication with said dispensing orifice.

18. The safety dispensing closure of claim 17 wherein an interference fit exists between said ball seals on said plug and protuberance and said ball seat to insure sealing by said plug in said first position and sealing by said protuberance in said second position.

* * * * *